US006532195B1

(12) United States Patent
Head

(10) Patent No.: US 6,532,195 B1
(45) Date of Patent: Mar. 11, 2003

(54) CLOCK SAVER APPARATUS AND METHODS

(75) Inventor: Jesse Spalding Head, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/283,476

(22) Filed: Apr. 1, 1999

Related U.S. Application Data

(60) Provisional application No. 60/080,521, filed on Apr. 3, 1998.

(51) Int. Cl.[7] ..... G04B 47/00; H05B 6/68

(52) U.S. Cl. ..... 368/64; 368/10; 368/66; 368/203; 368/204; 219/492; 219/506; 219/719; 219/720

(58) Field of Search ..... 368/64, 66, 203, 368/204, 10; 219/492, 506, 702, 719, 720; 364/143, 145, 187, 424.04, 480

(56) References Cited

U.S. PATENT DOCUMENTS

| | | | | |
|---|---|---|---|---|
| 4,531,214 A | | 7/1965 | Torres et al. | |
| 3,937,937 A | | 2/1976 | McVey | |
| 4,096,560 A | | 6/1978 | Footh | |
| 4,099,372 A | * | 7/1978 | Beyers, Jr. | 368/64 |
| 4,323,987 A | | 4/1982 | Holtz et al. | |
| 4,412,284 A | | 10/1983 | Kerforme et al. | |
| 4,458,307 A | | 7/1984 | McAnils et al. | |
| 4,523,295 A | | 6/1985 | Zato | |
| 4,602,165 A | * | 7/1986 | Rosenberg | 368/204 |
| 4,636,949 A | * | 1/1987 | Longabaugh | 364/143 |
| 4,685,614 A | * | 8/1987 | Levine | 368/203 |
| 4,819,237 A | | 4/1989 | Hamilton et al. | |
| 4,829,161 A | * | 5/1989 | Kadwell et al. | 219/506 |
| 4,939,652 A | * | 7/1990 | Steiner | 364/424.04 |
| 4,943,762 A | | 7/1990 | Campbell et al. | |
| 4,234,920 A | | 11/1990 | Nees et al. | |
| 5,012,406 A | | 4/1991 | Martin | |
| 5,285,452 A | | 2/1994 | Wee et al. | |
| 5,315,533 A | * | 5/1994 | Stich et al. | 364/480 |
| 5,542,042 A | | 7/1996 | Manson | |
| 5,825,648 A | * | 10/1998 | Karnowski | 364/143 |
| 6,069,848 A | * | 5/2000 | McDonald et al. | 368/10 |

OTHER PUBLICATIONS

Osaka, Kenichi, Rice Cooker with Timer Function, JP03234215A, abstract, Oct. 1991.*
Ishikawa, Kazuhiko, Memory Back–up System for Microcomputer, JP62126450A, abstract, Jun. 1987.*
Sakai, Motoo, Electronically Controlled Cooking Apparatus, JP01033425, abstract, Feb. 1989.*
Shibata, Satoru, Controller for Electrical Equipment, JP04310101A, abstract, Nov. 1992.*

* cited by examiner

*Primary Examiner*—Diego Gutierrez
*Assistant Examiner*—Jeanne-Marguerite Goodwin
(74) *Attorney, Agent, or Firm*—Armstrong Teasdale LLP

(57) ABSTRACT

Clock saver apparatus and methods which enable the restoration of clock operations in the event that a power outage is brief and without requiring that an operator reset the clock are described. In one embodiment, the clock is restored to a time setting equal to the time at which the power outage was detected. For example, if the power outage is detected at 11:08:32 a.m., then the restored time after restoration of power is set at 11:08:32 a.m. In another embodiment, the clock is restored to a time setting equal to the time at which the power outage was detected plus the determined time duration of the power outage. For example, if the power outage is detected at 11:08:32 a.m., and if the power outage duration is 15 seconds, then the restored time after restoration of power is set at 11:08:47 a.m.

39 Claims, 4 Drawing Sheets

CLOCK SAVER APPARATUS AND METHODS

CROSS REFERENCE TO RELATED APPLICATIONS

This application claims the benefit of U.S. Provisional No. 60/080,521 filed Apr. 3, 1998.

FIELD OF THE INVENTION

This invention relates generally to digital clocks for appliances (e.g., microwave ovens, ranges, and video cassette recorders) and more particularly, to apparatus and methods for controlling such digital clocks so that upon the occurrence of a short power outage, the clock may continue to operate upon restoration of power without requiring manual resetting.

BACKGROUND OF THE INVENTION

Microwave ovens, ranges, video cassette recorders, and many other appliances include a digital clock which displays the time of day. Power for the clock typically is obtained from the AC power line which supplies power to other appliance components. If the AC power is lost, even for a brief instant, the clock must be manually reset. Although having to reset the clock is not necessarily difficult or time consuming, it can be a nuisance.

It would be desirable to provide an appliance incorporating a digital clock which is tolerant to short power outages so that the clock does not necessarily need to be reset manually after a brief, e.g., 20–30 seconds, power outage. It also would be desirable to provide such a clock which has generally acceptable accuracy and does not add significant costs to the appliance.

SUMMARY OF THE INVENTION

These and other objects may be attained by clock saver apparatus and methods which enable the restoration of clock operations in the event that a power outage is brief and without requiring that an operator reset the clock. In one embodiment, the clock is restored to a time setting equal to the time at which the power outage was detected. For example, if the power outage is detected at 11:08:32 a.m., then the restored time after restoration of power is set at 11:08:32 a.m. In another embodiment, the clock is restored to a time setting equal to the time at which the power outage was detected plus the determined time duration of the power outage. For example, if the power outage is detected at 11:08:32 a.m., and if the power outage duration is 15 seconds, then the restored time after restoration of power is set at 11:08:47 a.m.

In an exemplary embodiment, the apparatus includes a microprocessor, a non-volatile memory coupled to the microprocessor, a user interface (e.g., a keypad and display) coupled to the microprocessor, and a time determining circuit coupled to the microprocessor for measuring an elapsed time from loss of power and restoration of power. The microprocessor includes a first port normally set to high during microprocessor operations. The microprocessor further includes a second port and an on-board analog to digital converter. The second port is coupled to the converter. The microprocessor also includes a power failure detection timer, and the power failure detection timer is reset once per line cycle. As is well known, there are sixty line cycles per second in a 60 Hz AC system.

The power outage time determining circuit includes a capacitor coupled to the first port of the microprocessor for receiving a charge during microprocessor operations. The capacitor also is coupled to the microprocessor second port so that a signal representative of the remaining charge stored in the capacitor is supplied to the second port.

In the above described embodiment, the microprocessor firmware controls operations of the microprocessor to perform the clock saver operations. Specifically, the microprocessor detects a predetermined condition associated with a power outage, and upon detection of the predetermined condition, the microprocessor stores clock data in the non-volatile memory. In the exemplary embodiment, the predetermined condition associated with the power outage is that a predetermined number (e.g., 3 or more) of AC line cycles have elapsed since resetting the power failure detection timer.

Upon restoration of power, the microprocessor determines whether the power outage duration was less than a predetermined time period. Particularly, the microprocessor determines the magnitude of the charge representative signal from the power outage time determining circuit. If the determined signal magnitude is greater than the predetermined value, then the power outage duration was shorter than the predetermined time period. If the determined signal magnitude is equal to or less than the predetermined value, then the power outage duration was longer than the predetermined time period.

If the power outage duration was less than the predetermined time period, the microprocessor restores clock operations using the stored clock data. Specifically, the microprocessor reads the stored clock data from the non-volatile memory and sets the clock using the read data. As explained above and in one embodiment, the clock is restored to a time setting equal to the time at which the power outage was detected. In another embodiment, the clock is restored to a time setting equal to the time at which the power outage was detected plus the determined time duration of the power outage.

The above described clock saver apparatus provides the desirable result that the appliance digital clock is tolerant to short power outages so that the clock does not necessarily need to be reset after a brief, e.g., 20–30 seconds, power outage. Even without adjusting the clock setting for the duration of the power outage, which is contemplated and possible as described above, the clock saver apparatus provides sufficient accuracy for most users and does not add significant costs to the appliance.

DETAILED DESCRIPTION

Appliances incorporating digital clocks are well known and commercially available. Such appliances include microwave ovens, ranges, and video cassette records (VCRs). Microwave ovens incorporating digital clocks are commercially available from, for example, General Electric Company, Louisville, Ky. Although the clock saver apparatus and methods are sometimes described herein in the context of microwave oven type appliances, such apparatus and methods are not limited to use in connection with only microwave ovens and may be used with many other types of appliances.

As explained above, power for the appliance digital clock typically is obtained from the AC power line which supplies power to other appliance components. If the AC power is lost, even for a brief instant, the clock must be reset by the user. Having to reset the clock can become a nuisance. The clock saver apparatus and methods described herein provide that the appliance digital clock is tolerant to short power outages so that the clock does not necessarily need to be reset after brief, e.g., 20–30 seconds, power outages.

Figure 1:
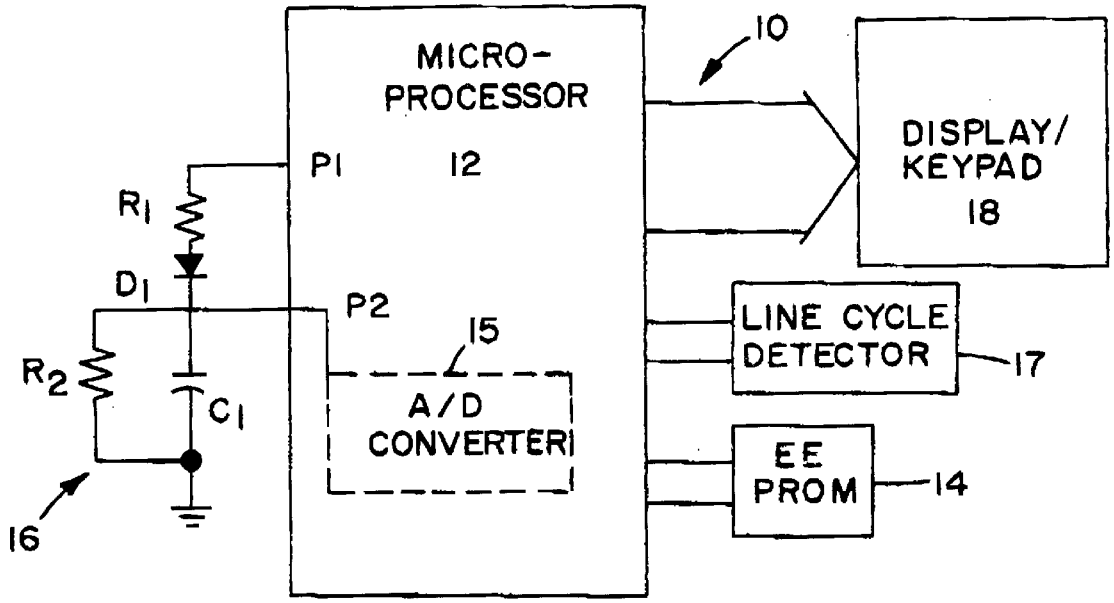
FIG. 1 is a schematic illustration of an exemplary embodiment of a clock saver apparatus.

Referring now specifically to the drawings, FIG. 1 is a schematic illustration of an exemplary embodiment of a clock saver apparatus 10. Apparatus 10 includes a microprocessor 12 and a non-volatile memory 14 coupled to microprocessor 12. As used herein, the term microprocessor 12 refers to microprocessors, microcontrollers, application specific integrated circuits, and any other types of circuits which can be configured to perform the functions described below. Microprocessor 12 includes a first port P1 normally set to high during microprocessor operations. Microprocessor 12 further includes a second port P2 and an on-board analog to digital converter 15. Second port P2 is coupled to converter 15.

Although memory 14 is illustrated as an electronically erasable programmable read only memory (EEPROM), many other types of non-volatile memories also could be used for storage of clock data as described below. Also, memory 14 could be incorporated onto microprocessor 12 itself and need not be a separate from microprocessor 12.

Apparatus 10 further includes a power outage time determining circuit 16 coupled to microprocessor 12 for measuring an elapsed time from loss of power and restoration of power. Time determining circuit 16 includes a capacitor C1 coupled to first port P1 through resistor R1 and diode D1. Generally, and since port P1 is set high during microprocessor operations, capacitor C1 receives a charge during normal operations. A resistor R2 is connected across capacitor C1, and the node at which resistor R2 and capacitor C1 are connected also is connected to port P2. Generally, a voltage across resistor R2 is representative of the charge of capacitor C1, and the voltage across resistor R2 is supplied to second port P2. The voltage signal is representative of the charge stored in capacitor C1. Of course, other variations are possible. For example, resistor R1 could be eliminated, and resistor R2 could be connected between port P2 and the node connecting diode D1 and capacitor C1.

Apparatus 10 includes a line cycle detector 17. Line cycle detector 17 detects zero crossings and provides data to microprocessor 12 relating to line cycles. Zero crossing detection is well known in the art. As described below in more detail, the line cycle data is utilized by microprocessor 12 to determine the onset of a power outage.

Figure 2:
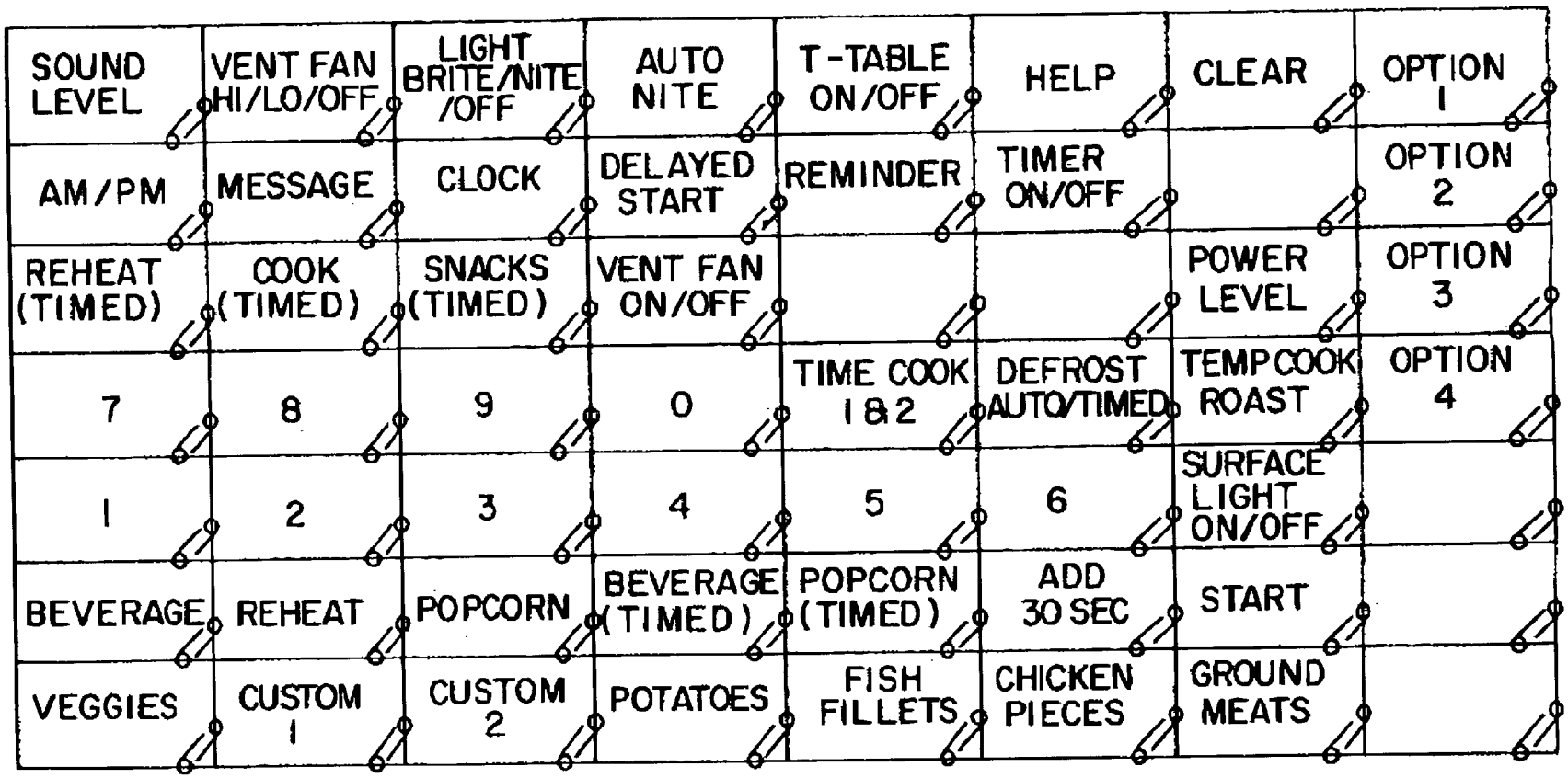
FIG. 2 is a matrix illustrating typical keypads (e.g., functional and numeric keypads) of a microwave oven.

Apparatus 10 also includes a user interface 18 (e.g., a keypad and display) coupled to microprocessor 12. A matrix illustrating typical keypads for a microwave oven is set forth in FIG. 2. As shown in FIG. 2, the keypad includes functional pads and numeric pads. Fewer or more pads may be included with a particular microwave oven depending upon the particular model and manufacturer. In any event, an operator may input commands and data to microprocessor 12 via keypad, and microprocessor 12 can display messages as well as a time of day via user interface 18.

Figure 3:
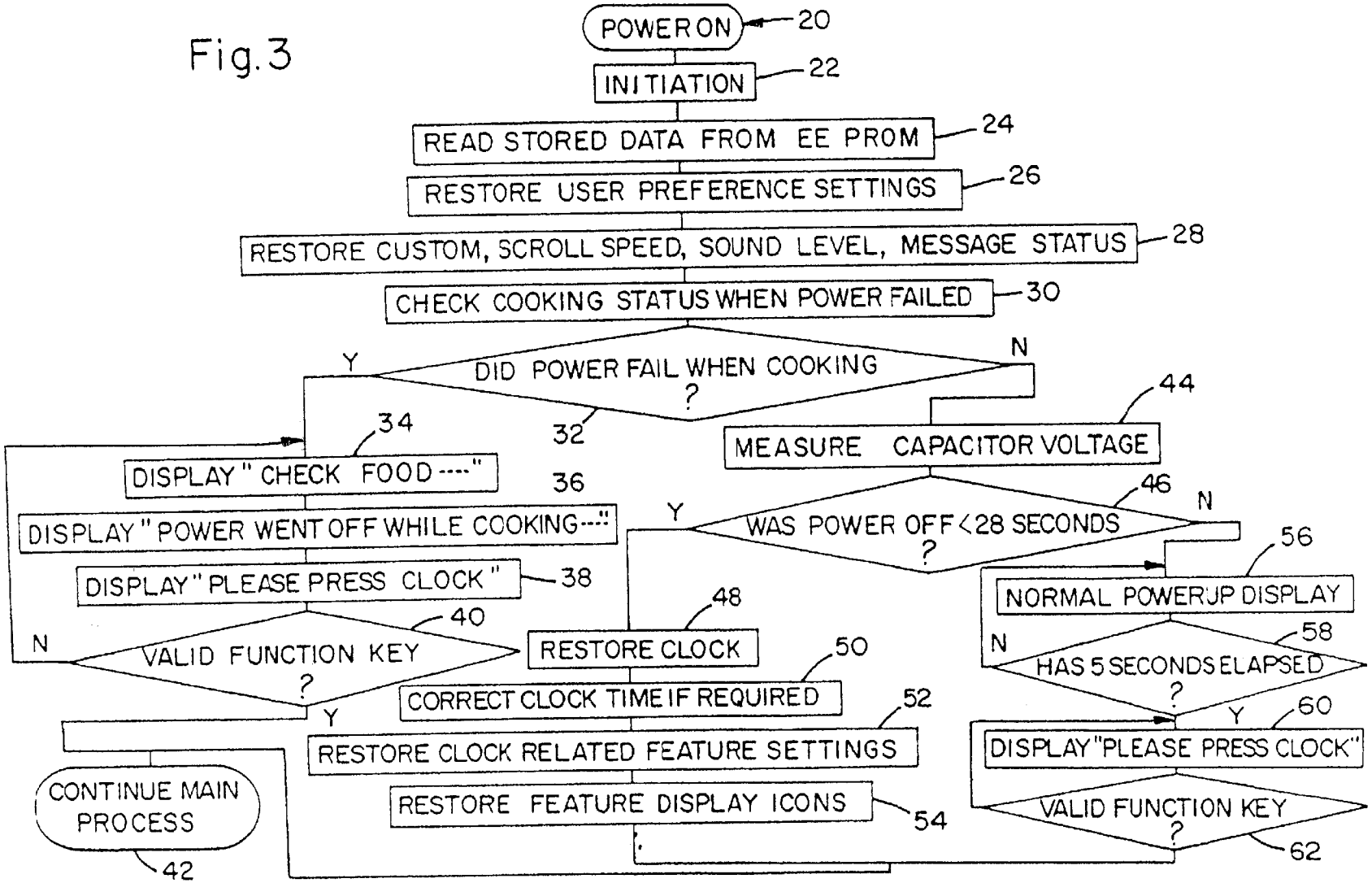
FIG. 3 is a flow chart illustrating processing steps executed in performing the clock saver operations in accordance with one embodiment of the present invention.

FIG. 3 is a flow chart illustrating processing steps of a power on routine 20 executed in performing the clock saver operations in accordance with one embodiment of the present invention. The processing illustrated in FIG. 3 would be performed by microprocessor 12 (FIG. 1) operating under the control of firmware using well known techniques. Microprocessor 12 is therefore configured, or programmed, to perform the operations. Of course, such operations could be performed by other types of circuits and are not limited to practice in a microprocessor.

As shown in FIG. 3, once routine 20 is initiated, processor 12 performs initialization processes 22 to, for example, initialize random access memory and local variables. In addition, and during initialization 22, port P1 is set to high, i.e., a +5V charge is present at port P1. As a result, capacitor C1 is fully charged almost immediately.

After completion of initialization 22, data stored in EEPROM is read 24 by processor 12. On the initial operation of processor 12, random or junk bits may be set in EEPROM 14. On power-up after a power outage, however, real data may be stored in EEPROM 14. To distinguish between real data and junk, processor 12 checks whether the format of data read from EEPROM 14 conforms to the predefined data storage format.

If the EEPROM data does conform to the format, then processor 12 uses such data to restore user preference settings 26 (e.g., the CUSTOM settings, scroll speed, sound level, and message status 28). Particularly, and if power is being restored after a power outage, user preference settings would have been stored in EEPROM 14 upon detection of the outage as described below in more detail. These settings are retrieved from EEPROM 14 upon restoration of power. If the data does not conform to the format, then default values preset at the factory and embodied in the firmware are used to restore the user preference settings. On the initial power-up operation, for example, the EEPROM data will be junk and the default values are used.

After restoring user preference settings, processor 12 checks the cooking status when power failed 30. Although it is not likely that a power outage will occur during cooking, it is possible. If power failed while cooking 32, then food may be in the oven and certain user instructions are displayed. If power did not fail while cooking, then a different set of operations are performed. In any event, and to determine whether power failed while cooking 32, processor 12 checks a predesignated memory location in EEPROM 14 to determine whether a bit is set high or low. For example, if the bit is set low, then power did not fail while cooking, and if the bit is set high, then power did fail while cooking. As described below in more detail in connection with power failure detection, and if power fails while cooking, processor 12 sets the bit high, otherwise the bit is low.

If power did fail while cooking, then processor 12 displays messages on user interface. A first message 34 displayed is "CHECK FOOD - - - ". A second message 36 displayed is "POWER WENT OFF WHILE COOKING - - - ". A third message 38 displayed is "PLEASE PRESS CLOCK". If a valid function key is not pressed 40, the messages will continue to scroll on display until a valid key is pressed. Once a valid key is pressed, main processing operations continue 42, e.g., the user then sets the clock in accordance with standard operations as described below in more detail.

If power did not fail when cooking, then it may be possible for the clock operations to be restored without requiring that the user reset the clock. Particularly, processor 12 measures 44 the magnitude of the voltage of capacitor C1 by determining the magnitude of the voltage at port P2. Processor 12 obtains this information from the on-board analog to digital converter 15 coupled to port P2. Using the determined magnitude, processor 12 determines whether the power outage duration was less than a predetermined time period 46, e.g., twenty seconds. For example, and to make such determination, microprocessor 12 compares the determined signal magnitude with a predetermined value which is equal to the charge expected to be at port P1 in the event that capacitor C1 had been discharging for less than approximately twenty seconds. If the determined signal magnitude is greater than the predetermined value, then the power outage duration was shorter than the predetermined time period. If the determined signal magnitude is equal to or less than the predetermined value, then the power outage duration was longer than the predetermined time period. Of course, the predetermined time period could be less than or greater than twenty seconds.

If processor 12 determines that the power outage was less than twenty seconds, processor 12 retrieves the clock data stored in EEPROM 14 and restores the clock setting using such data 48. In one embodiment, processor 12 may also correct the retrieved clock data 50 to add in the time of the power outage. The duration of the power outage may be determined, for example, using a look-up table having values stored therein correlating the magnitude of the charge at port P2 and the length of the outage. Such data can be collected by performing an empirical study. Alternatively, microprocessor 12 could be configured to calculate the correlation between the charge at port P2 and the length of the outage.

Processor 12 then restores clock related feature settings 52 such as the AUTO NITE timer. The AUTO NITE timer is a programmable timer that turns on and turns off a night light which is part of the microwave oven. The user selects when the light is to automatically turn on and off. Once such feature settings are restored, the feature display icons also are restored 54. For example, and if the AUTO NITE timer is activated, an icon is displayed on interface 18. Operations then continue to with main processing.

If processor 12 determines that the power outage was not less than twenty seconds 42, processor 12 executes normal powerup display operations 56. For example, and for five seconds, all display elements are energized so that if a user is present, the user can verify whether all the display elements are working. Once five seconds elapse 58, processor causes the message "PLEASE PRESS CLOCK" to be displayed 60 at interface 18. This message continues to scroll on display 18 until the user presses a valid function key. Once the user presses a valid function key, then operations return to main processing 42.

Figure 4:
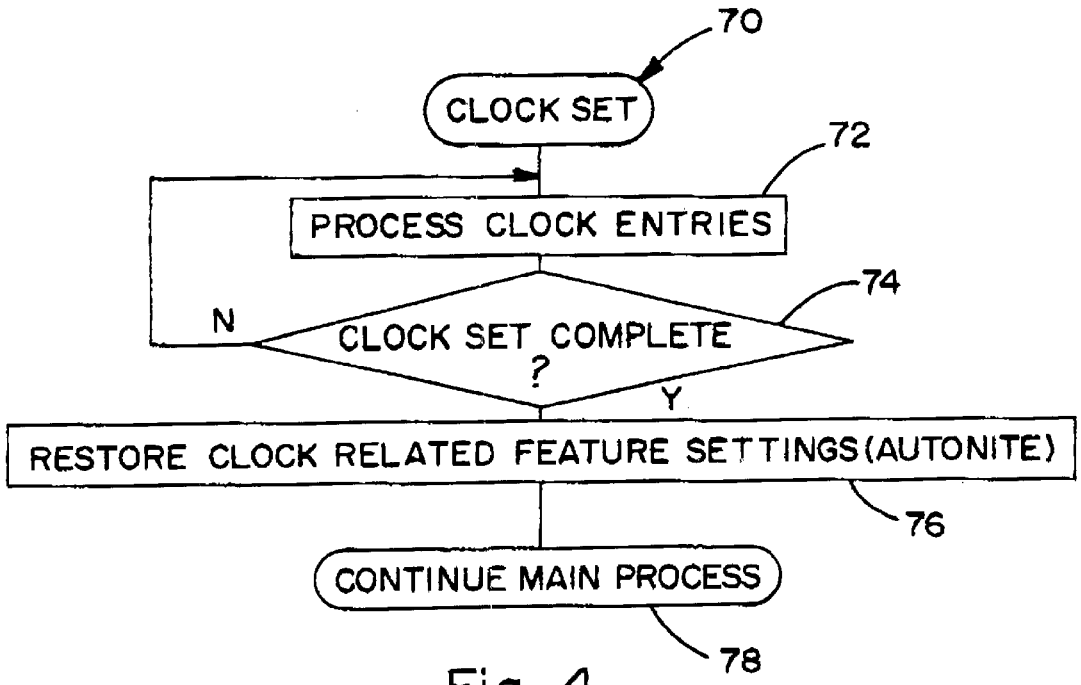
FIG. 4 is a flow chart illustrating exemplary processing steps executed when setting a digital clock.

FIG. 4 is a flow chart illustrating an exemplary clock set routine 70 executed by processor 12 when the appliance clock is set manually. An icon may flash once the clock set routine is initiated and continues to flash until the routine is complete. Particularly, a user inputs entries to processor via user interface 18. Processor 12 then processes 72 the received entries. If all the entries have not been processed 74, processor 12 continues to process the entries 72. Typically, a user must press the CLOCK or START pad in order to start the clock running. Once all the entries have been processed, processor 12 restores clock related feature settings 76 such as the AUTO NITE timer. Operations then continue with the main processing 78.

Figure 5:
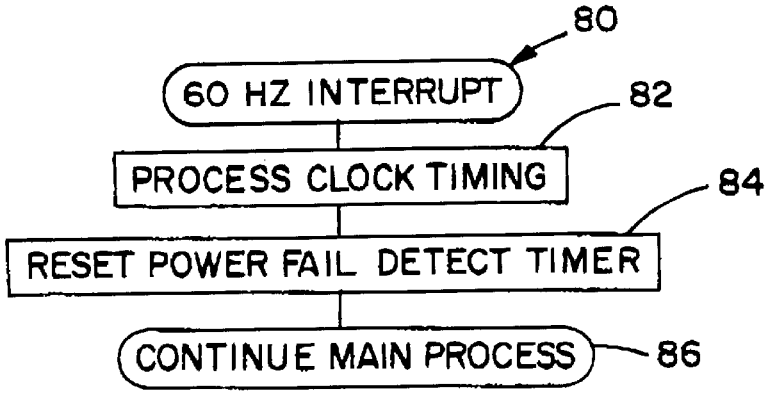
FIG. 5 is a flow chart illustrating exemplary processing steps executed when performing a 60 Hz interrupt.

FIG. 5 illustrates a 60 Hz interrupt routine 80 executed by processor 12 when processor 12 is energized. As explained above, processor 12 typically is energized by an AC signal having a frequency of 60 Hz. A zero crossing occurs 60 times per second with such an AC signal, i.e., 60 line cycles per second. Zero crossing circuits are well known in the art, and upon detection of a zero crossing, the 60 Hz interrupt routine 80 is called by processor 12. Processor 12 then processes 82 clock timing data, e.g., processes updates clock registers for seconds, minutes, and hours, and resets a powerfail detect timer to zero 84. If power is supplied to processor 12 for one second, for example, then the powerfail detect timer will be reset 60 times during the one second interval. Operations then continue with the main processing 86.

Figure 6:
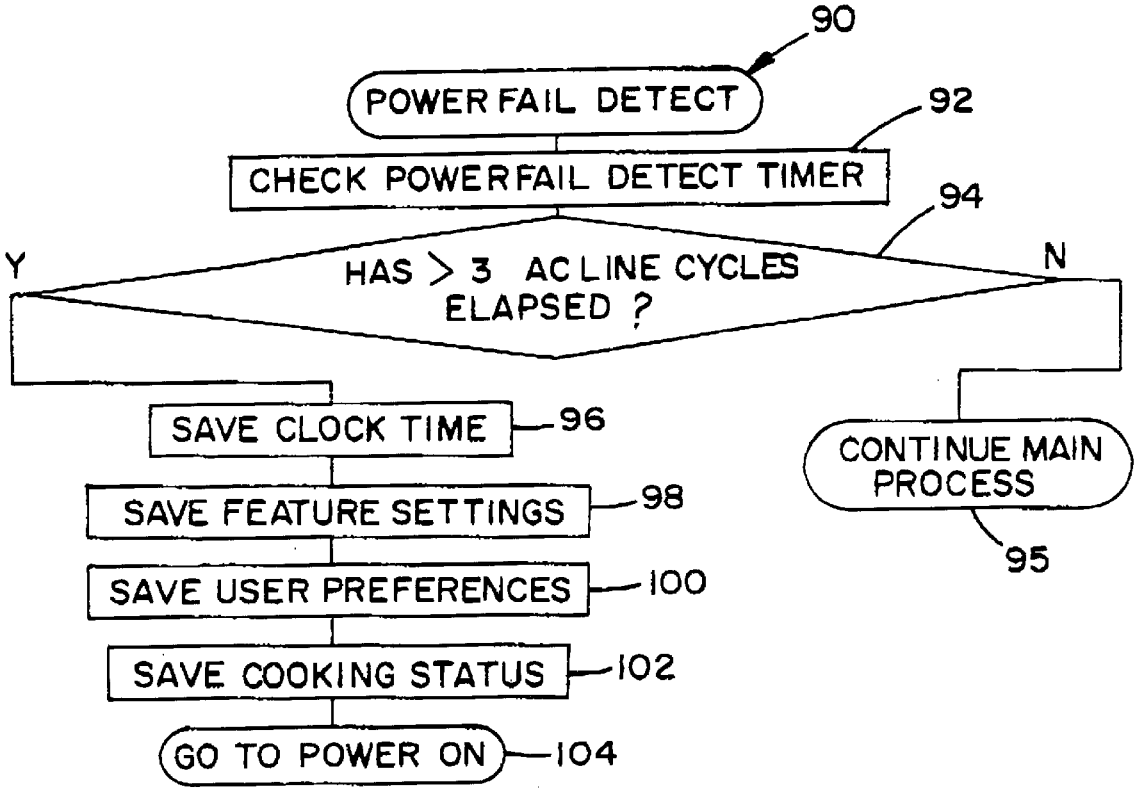
FIG. 6 a flow chart illustrating exemplary processing steps executed when performing power failure detection.

FIG. 6 is a flow chart illustrating a power failure detection routine 90 executed by processor 12 using the powerfail detect timer described above in connection with FIG. 5. Upon initiation of power failure detection routine 90, processor 12 checks the powerfail detect timer 92. If the timer value is less than or equal to the time required to complete 3 AC line cycles 94 (e.g., 1/20th of a second), then operations return to the main processing 95. If the timer value is greater than the time required to complete 3 AC line cycles 94, however, then this circumstance indicates that a power outage may occur. Of course, fewer or more than 3 AC line cycles can be used. Processor 12 therefore saves the clock time 96, feature settings 98, user preferences 100, and cooking status 102 in EEPROM 14. Operations then return 104 to power on routine 20 illustrated in FIG. 3. Upon restoration of power, power on routine 20 illustrated in FIG. 3 is initiated.

The above described clock saver apparatus and methods provide the desirable result that the appliance digital clock is tolerant to short power outages so that the clock does not necessarily need to be reset after a brief, e.g., 20–30 seconds, power outage. Even without adjusting the clock setting for the duration of the power outage, the clock saver apparatus provides sufficient accuracy for most users and does not add significant costs to the appliance.

As explained above, many variations and modifications are possible. For example, and rather than requiring manual resetting of the clock if power fails while cooking as shown in FIG. 3, the clock could simply be automatically reset provided that the power failure was less than a predetermined time. In such an embodiment, and rather than displaying the message "PLEASE PRESS CLOCK" as indicated at step 38 in FIG. 3, the message "PLEASE PRESS CLEAR" could be displayed. Subsequent to detecting whether a valid function key has been pressed, operations would proceed to measuring the capacitor C1 voltage as indicated at step 44. Many other modifications are possible.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. Apparatus for restoring clock operations in an appliance clock subsequent to a power outage, said apparatus comprising a microprocessor coupled to non-volatile memory, said microprocessor configured to:

detect a predetermined condition associated with a power outage;

store clock data in said non-volatile memory upon detection of the predetermined condition;

upon restoration of power, determine whether the power outage duration was less than a predetermined time period; and if the power outage duration was less than said predetermined time period, restore clock operations using the stored clock data.

2. Apparatus in accordance with claim 1 wherein said microprocessor further comprises a power fail detection timer, said microprocessor configured to reset said power failure detection timer upon detection of a zero crossing of an AC signal supplying power to said microprocessor.

3. Apparatus in accordance with claim 2 wherein to detect said predetermined condition associated with the power outage, said microprocessor is configured to determine whether a predetermined number of AC line cycles have elapsed since resetting said power failure detection timer.

4. Apparatus in accordance with claim 3 wherein said predetermined number of AC line cycles is at least three.

5. Apparatus in accordance with claim 1 wherein said non-volatile memory comprises an electronically erasable programmable read only memory.

6. Apparatus in accordance with claim 1 further comprising a capacitor coupled to a first port of said microprocessor said first port normally set high when said microprocessor is energized so that said capacitor is fully charged.

7. Apparatus in accordance with claim 6 wherein said microprocessor further comprises a second port, said capacitor coupled to said second port so that a signal representative of a charge remaining in said capacitor is supplied to said second port.

8. Apparatus in accordance with claim 7 wherein to determine whether the power outage duration was less than said predetermined time period, said microprocessor is configured to determine a magnitude of the charge representative signal.

9. Apparatus in accordance with claim 8 wherein said microprocessor is further configured to compare the determined signal magnitude with a predetermined value, and wherein if the determined signal magnitude is greater than the predetermined value, then determining that the power outage duration was shorter than said predetermined time period.

10. Apparatus in accordance with claim 8 wherein said microprocessor is further configured to compare the determined signal magnitude with a predetermined value, and wherein if the determined signal magnitude is less than the predetermined value, then determining that the power outage duration was longer than said predetermined time period.

11. Apparatus in accordance with claim 1 wherein said predetermined time period is at least twenty seconds.

12. Apparatus in accordance with claim 1 wherein to restore clock operations, said microprocessor is configured to read the stored clock data in said non-volatile memory.

13. Apparatus in accordance with claim 12 wherein to restore clock operations, said microprocessor is further configured to determine a time period about equal to the duration of the power outage and to add said determined time period to the stored clock data.

14. Apparatus for restoring clock operations in an appliance clock subsequent to a power outage, said apparatus comprising a microprocessor, a user interface coupled to said microprocessor, and a time determining circuit coupled to said microprocessor for measuring an elapsed time from loss of power to said microprocessor and restoration of power to said microprocessor, said microprocessor comprises a power failure detection timer, said microprocessor configured to reset said power failure detection timer upon detection of a zero crossing of an AC signal supplying power to said microprocessor.

15. Apparatus in accordance with claim 14 wherein said user interface comprises a keypad comprising functional and numeric keypads.

16. Apparatus in accordance with claim 14 wherein said microprocessor comprises a first port and a second port, said first port normally set to high during operation of said microprocessor, said microprocessor further comprising an on-board analog to digital converter, said second port coupled to said converter.

17. Apparatus in accordance with claim 16 wherein said time determining circuit comprises a capacitor coupled said first port of said microprocessor for receiving a charge during microprocessor operations, said capacitor coupled to said second port so that a signal representative of a charge remaining in said capacitor is supplied to said second port.

18. Apparatus in accordance with claim 14 further comprising a nonvolatile memory coupled to said microprocessor.

19. A method for restoring clock operations in an appliance, said method comprising the steps of:

detecting a predetermined condition associated with a power outage;

storing clock data upon detection of the predetermined condition;

upon restoration of power, determining whether the power outage duration was less than a predetermined time period; and if the power outage duration was less than the predetermined time period, restoring clock operations using the stored clock data.

20. A method in accordance with claim 19 wherein the appliance includes the power failure detection timer, and detecting the predetermined condition associated with the power outage comprises the step of determining whether a predetermined number of AC line cycles have elapsed since resetting the power failure detection timer.

21. A method in accordance with claim 20 wherein the predetermined number of AC line cycles is at least three.

22. A method in accordance with claim 19 wherein the appliance includes a non-volatile memory and storing clock Upon detection of the predetermined condition comprises the step of storing the clock data in the non-volatile memory.

23. A method in accordance with claim 19 wherein the appliance includes a power outage time determining circuit and determining whether the power outage duration was less than the predetermined time period comprises the step of comparing the power outage time determining circuit output with a predetermined value.

24. A method in accordance with claim 19 wherein restoring clock operations using the stored clock data comprises the step of adding to the stored clock data a time period about equal to the time period of the power outage.

25. Apparatus for restoring clock operations in an appliance clock subsequent to a power outage, said apparatus comprising a microprocessor and a non-volatile memory coupled to said microprocessor, said microprocessor comprising a first port and a second port, said first port normally set to high during operation of said microprocessor, said microprocessor further comprising an on-board analog to digital converter, said second port coupled to said converter, said apparatus further comprising a user interface coupled to said microprocessor, and a power outage time determining circuit coupled to said microprocessor for measuring an elapsed time from loss of power to said microprocessor and restoration of power to said microprocessor, said power outage time determining circuit comprising a capacitor coupled to said first port of said microprocessor for receiving a charge during microprocessor operations, said capacitor coupled to said second port so that a signal representative of a charge stored in said capacitor is supplied to said second port, said microprocessor configured to:

detect a predetermined condition associated with the power outage;

store clock data in said non-volatile memory upon detection of said predetermined condition;

upon restoration of power, determine whether the power outage duration was less than a predetermined time period; and if the power outage duration was less than said predetermined time period, restore clock operations using the stored clock data.

26. Apparatus in accordance with claim 25 wherein said microprocessor further comprises a power failure detection timer, said microprocessor configured to reset said power failure detection timer once per line cycle of an AC signal supplying power to said microprocessor.

27. Apparatus in accordance with claim 26 wherein to detect said predetermined condition associated with the power outage, said microprocessor is configured to determine whether a predetermined number of AC line cycles have elapsed since resetting said power failure detection timer.

28. Apparatus in accordance with claim 26 wherein to determine whether the power outage duration was less than said predetermined time period, said microprocessor is configured to determine a magnitude of the charge representative signal.

29. Apparatus in accordance with claim 28 wherein said microprocessor is further configured to compare the determined signal magnitude with a predetermined value, and wherein if the determined signal magnitude is greater than the predetermined value, then determining that the power outage duration was shorter than said predetermined time period.

30. Apparatus in accordance with claim 28 wherein said microprocessor is further configured to compare the determined signal magnitude with a predetermined value, and wherein if the determined signal magnitude is less than the predetermined value, then determining that the power outage duration was longer than said predetermined time period.

31. Apparatus in accordance with claim 25 wherein to restore clock operations, said microprocessor is configured to read the stored clock data in said non-volatile memory.

32. Apparatus in accordance with claim 31 wherein to restore clock operations, said microprocessor is further configured to determine a time period about equal to the duration of the power outage and to add said determined time period to the stored clock data.

33. A microprocessor for controlling operation of an appliance clock for an oven subsequent to a power failure, said microprocessor programmed to:

determine whether the power failure occurred while cooking;

if the power failure did not occur while cooking, and if the length of the power failure was less than a predetermined time, then restoring clock operation without requiring a user to input clock entries; and if the power failure did occur while cooking, and if the length of the power failure was greater than a predetermined time, then requiring a user to input clock entries before restoring clock operation.

34. A microprocessor in accordance with claim 33 wherein said microprocessor is coupled to a non-volatile memory, and wherein to determine whether the power failure occurred while cooking, said microprocessor obtains data from said non-volatile memory.

35. A microprocessor in accordance with claim 33 further comprising a first port normally set high during operation of said microprocessor, an on-board analog to digital converter, and a second port coupled to said converter.

36. A microprocessor in accordance with claim 33 wherein said microprocessor further programmed to:

if the power failure did not occur while cooking, and if the length of the power failure was less than a first predetermined time, then restoring clock operation without requiring a user to input clock entries; and if the power failure did occur while cooking, and if the length of the power failure was greater than a second predetermined time different than the first predetermined time, then requiring a user to input clock entries before restoring clock operation.

37. A microprocessor for controlling operation of an appliance clock for an oven subsequent to a power failure, said microprocessor programmed to:

determine whether the power failure occurred while cooking;

if the power failure occurred while cooking, then requiring a user to input an entry before restoring operation; and if the length of the power failure was less than a predetermined time, then restoring clock operation without requiring a user to input clock entries.

38. A microprocessor in accordance with claim 37 wherein said microprocessor is coupled to a non-volatile memory, and wherein to determine whether the power failure occurred while cooking, said microprocessor obtains data from said non-volatile memory.

39. A microprocessor in accordance with claim 37 further comprising a first port normally set high during operation of said microprocessor, an on-board analog to digital converter, and a second port coupled to said converter.

* * * * *

UNITED STATES PATENT AND TRADEMARK OFFICE

CERTIFICATE OF CORRECTION

PATENT NO. : 6,532,195 B1
DATED : March 11, 2003
INVENTOR(S) : Jesse Spalding Head It is certified that error appears in the above-identified patent and that said Letters Patent is hereby corrected as shown below:

Column 7,
Line 25, after "microprocessor" insert -- , --.

Column 8,
Line 16, between "coupled" and "said" insert -- to --.
Line 37, delete "the power" and insert therefor -- a power --.
Line 46, delete "Upon" and insert therefor -- data upon --.

Signed and Sealed this

Ninth Day of September, 2003

JAMES E. ROGAN
*Director of the United States Patent and Trademark Office*